United States Patent [19]

Ooms et al.

[11] Patent Number: 4,689,519

[45] Date of Patent: Aug. 25, 1987

[54] ELECTRIC LAMP HAVING AN OUTWARDLY EXTENDING PROTRUSION

[75] Inventors: Leo F. M. Ooms; Victor R. Notelteirs, both of Eindhoven, Netherlands

[73] Assignee: U.S. Philips Corporation, New York, N.Y.

[21] Appl. No.: 807,378

[22] Filed: Dec. 10, 1985

[30] Foreign Application Priority Data

Oct. 23, 1985 [NL] Netherlands ..... 8502888

[51] Int. Cl.[4] ..... H01K 1/26; H01K 1/32

[52] U.S. Cl. ..... 313/112; 313/580

[58] Field of Search ..... 313/578, 579, 112, 114, 313/580, 635; 350/1.6, 164, 166; 362/293

[56] References Cited

U.S. PATENT DOCUMENTS 4,588,923 5/1986 Hoegler et al. ..... 313/112 X

*Primary Examiner*—David K. Moore
*Assistant Examiner*—K. Wieder
*Attorney, Agent, or Firm*—David R. Treacy

[57] ABSTRACT

The electric lamp according to the invention has a mainly tubular glass lamp vessel (1) coated with an interference filter (5) of alternating layers of $SiO_2$ and of a material having a comparatively high refractive index. The lamp vessel 1 has portions at the area of and near its seals (6,7) having a form deviating from the tubular form and is in situ free from the material having a high refractive index of the interference filter (5). As a result, the lamp vessel (1) has a comparatively high resistance to pressure.

11 Claims, 1 Drawing Figure

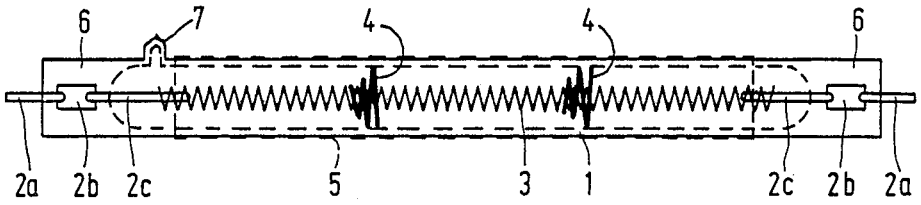
6
7
4
4
6
2a
2b
2c
5
3
1
2c
2b
2a

ELECTRIC LAMP HAVING AN OUTWARDLY EXTENDING PROTRUSION

The invention relates to an electric lamp provided with a gas-filled lamp vessel sealed in a vacuum-tight manner and made of glass having an $SiO_2$ content of at least 95% by weight, and current supply conductors extending through the wall of this lamp vessel to an electric element arranged within the lamp vessel.

The lamp vessel has a coating forming an interference filter make of alternating layers of mainly $SiO_2$ and of a material having a comparatively high refractive index. The lamp vessel is also substantially tubular and has portions at the area near its seals having a form deviating from the tubular form such as an outwardly extending protrusion.

Such a lamp is known from British Patent Specification No. 2,103,830.

Due to the presence of an interference filter, the spectrum of the radiation emitted by the lamp differs from that in the absence of such a filter. The filter can be used in an incandescent lamp to reflect infrared radiation so that the thermal losses in the lamp are reduced and the lamp has a higher efficiency. Another possibility is to ensure that the filter reflects light of a given wavelength, as a result of which the lamp emits colored light. For example, with metal halide discharge lamps, the filter can be used, for example, to reflect infrared radiation.

The known lamp has an interference filter of alternating layers of $SiO_2$ and $Ta_2O_5$, but other materials may be used instead, such as, for example, $SiO_2$ and $Si_3N_4$.

The interference filter is obtained by applying by vapor desposition alternating layers of $SiO_2$ (which has a comparatively low refractive index) and a material having a comparatively high refractive index to a tube of glass having a high $SiO_2$ content, such as quartz glass. It is also possible to apply such layers by pyrolysis of compounds in the vapour phase (C.V.D.).

However, it has been found that lamps of the kind mentioned in the opening paragraph are not very resistant to a high gas pressure in the lamp and can explode at a comparatively low pressure.

The invention has for its object to provide a lamp of the kind mentioned in the opening paragraph, which has a comparatively high resistance to pressure.

According to the invention, this object is achieved in that the outwardly extending protruding portions of the lamp vessel having a form deviating from the tubular form are at least substantially free from the material of comparatively high refractive index of the interference filter.

Experiments leading to the invention have shown that a lamp having a low resistance to pressure is obtained if the tube, from which the lamp vessel is formed, is deformed at an area at which the interference filter is present. Such deformations of this tube are necessary to seal the tube. These deformations are obtained, for example, during the operation of making pinch seals, the operation of making seals onto current supply conductors, during which operation the tube is caused to collapse at an end thereof around such a conductor, and the operation of sealing an exhaust tube.

It is remarkable that deformation of a tube portion coated with the interference filter leads to weakening of the lamp vessel. Due to the high temperature that locally has to be given to the tube in order to be able to deform it, the interference filter in fact disappears at that location.

Although it is true that the optical properties of the interference filter are lost at a temperature required for deformation of the tube, the materials of which the filter is composed do not disappear completely, but instead merge with each other and with the tube wall. It is assumed that as a result stresses are produced in the lamp vessel formed, which lead to a reduced resistance to high pressures.

The increased resistance to pressure of the lamp according to the invention can be attained in that the portions to be deformed of a tube from which a lamp vessel will be formed are screened when the interference filter is applied to the tube in order that these parts are not coated with the interference filter.

The effect of the measure taken in the lamp according to the invention appears from the following experiment.

Quartz glass tubes of a first series had a coating with an interference filter reflecting infrared radiation consisting of alternating layers of $SiO_2$ and $Ta_2O_5$ except at their two ends. At the center of the tubes an exhaust tube of quartz glass was secured by fusion, the tubes being deformed in situ. The tubes were closed, without coated portions being deformed, at their two uncoated ends by giving these ends a hemispherical form. The filter was protected from deposition of quartz vapor by passing an air current along the filter. Via the exhaust tube, a pressure was built up in the tube until an explosion occurred at 793 $N/cm^2$.

Quartz glass tubes of a second series had throughout their length the same coating as the tubes of the first series. They were provided at the center with an exhaust tube and closed at their ends. The tubes of this series exploded at 780 $N/cm^2$.

Quartz glass tubes of a third series were identical to those of the first series. The tubes were provided with an exhaust tube and closed at their ends, like the tubes of the first series, but the exhaust tube was arranged near one of the ends at an uncoated area. The tubes of this version did not explode until a pressure of 1062 $N/cm^2$ was reached.

The tubes which are deformed only at an uncoated area consequently have a considerably higher resistance to pressure than tubes deformed at a coated area.

The lamp according to the invention may be an incandescent lamp, in which the electric element is a filament, more particularly a halogen incandescent lamp, in which the gas filling is an inert gas containing a halogen or a halogen compound, or a discharge lamp. In the latter case, the electric element is a pair of electrodes and the lamp vessel contains an ionizable gas, such as a rare gas, mercury or metal halides.

An embodiment of the lamp according to the invention is shown in the drawing in side elevation.

In the drawing, the lamp has a quartz glass lamp vessel 1 which is sealed in a vacuum-tight manner, is substantially tubular, and is filled with an inert gas and hydrobromide. Current supply conductors *2a, 2b, 2c* extend through the wall of the lamp vessel 1 to a filament 3 which is arranged inside it and is held in a centered position by supporting members 4. The current supply conductors consist of a molybdenum wire *2a* welded to a molybdenum foil *2b*, to which a tungsten wire *2c* is secured. The lamp vessel 1 is connected to the molybdenum foils *2b* in a vacuum-tight manner by means of pinch seals 6. Although lamps without an exhaust tube can also be manufactured, the lamp shown has an exhaust tube residue 7. Before sealing the exhaust tube, during which process the residue 7 was obtained, the lamp vessel 1 is evacuated via this exhaust tube and is provided with its gas filling.

The lamp vessel 1 is tubular except at the area of the residue 7 of the exhaust tube, and also at the area of the pinch seals 6 and in the proximity thereof where the lamp vessel 1 has a form deviating from the tubular form due to the seals made. The location of the exhaust tube residue 7 near pinch seal 6 instead of, for example, at the center of the lamp vessel 1 is advantageous because the filament 3 is then laterally surrounded throughout its length by the filter 5.

The lamp vessel 1 is coated for the most part with an interference filter reflecting infrared radiation, transmitting visible radiation, and consisting of alternating layers of $SiO_2$ (n=1.46) and $Ta_2O_5$(n=2.13). Parts of the lamp vessel 1 which have been heated to a high temperature in order to obtain the form deviating from the tubular form, i.e. at the area of and near its seals 6 and 7, are free from $Ta_2O_5$, i.e. the material having a comparatively high refractive index of the interference filter.

The absence of the interference filter near the ends of the lamp shown substantially does not unfavorably influence the efficiency of the lamp. The filament 3 is laterally surrounded throughout its length by the interference filter 5 as for as the current supply conductors 2c. Only infrared radiation emitted obliquely at an acute angle to the axis of the lamp towards the ends of the lamp can leave the lamp vessel 1 along the filter 5. For such a radiation emitted obliquely near the ends of the lamp, an interference filter would not be very effective, however, because this radiation would be reflected on the filament only to a small extend and after a multiple reflection.

What is claimed is:

1. An electric lamp comprising:

a gas-filled lamp vessel sealed in a vacuum-tight manner, said vessel being made of a glass having an $SiO_2$ content of at least 95% by weight, said vessel having a vessel wall including a pinch seal at an end;

an electric element arranged inside said lamp vessel;

current supply conductors extending inwardly through said vessel wall and connecting to said electric element; and a coating disposed on a first portion of said vessel wall, said electric element being at least partially surrounded laterally by said coating, said coating comprising an interference filter including alternating layers of a first material having a low refractive index and a second material having a comparatively high refractive index;

said lamp vessel wall having a second portion near and extending to a location exterior to one of said pinch seals, said second portion and said pinch seal being substantially free of said coating to provide high resistance to explosion.

2. A lamp according to claim 1, wherein said coating is disposed on said first portion of said vessel wall extending as far as said current supply conductor, said electric element being surrounded laterally throughout its entire length by said coating.

3. An electric lamp comprising:

a gas-filled lamp vessel sealed in a vacuum-tight manner, said vessel being made of a glass having an $SiO_2$ content of at least 95% by weight, said vessel having a vessel wall including a pinch seal at an end;

an electric element arranged inside said lamp vessel;

current supply conductors extending inwardly through said vessel wall and connecting to said electric element; and a coating disposed on a first portion of said vessel wall, said electric element being at least partially surrounded laterally by said coating, said coating comprising an interference filter including alternating layers of a first material having a low refractive index and a second material having a comparatively high refractive index;

said lamp vessel wall having a second portion having an outwardly protruding portion formed therein, near one of said pinch seals, said second portion and said pinch seal being substantially free of said second material to provide high resistance to explosion.

4. A lamp according to claim 3, wherein said coating is disposed on said first portion of said vessel wall extending as far as said current supply conductor, said electric element being surrounded laterally throughout its entire length by said coating.

5. A lamp according to claim 4, characterized in that said first material is $SiO_2$, and said second material has a refractive index higher than that of $SiO_2$.

6. A lamp according to claim 5, characterized in that said second material is $Ta_2O_5$.

7. A lamp according to claim 5, characterized in that said protruding portion is an exhaust tube residue.

8. An electric lamp comprising:

a gas-filled lamp vessel sealed in a vacuum-tight manner, said vessel being made of a glass having an $SiO_2$ content of at least 95% by weight, said vessel having a tubular vessel wall having two ends and a pinch seal at each end, and an exhaust tube residue protruding from said tubular wall near one of said ends;

an electric element arranged inside said lamp vessel;

current supply conductors extending inwardly through said vessel wall and connecting to said electric element; and a coating disposed on a portion of said tubular wall, said electric element being at least partially surrounded laterally by said coating, said coating comprising an interference filter including alternating layers of a first material having a low refractive index and a second material having a comparatively high refractive index;

said exhaust tube residue being substantially free of said second material to provide high resistance to explosion.

9. A lamp according to claim 8, wherein said coating is disposed on said portion of said vessel wall extending as far as said current supply conductor, said electric element being surrounded laterally throughout its entire length by said coating.

10. A lamp according to claim 9, characterized in that said first material is $SiO_2$, and said second material has a refractive index higher than that of $SiO_2$.

11. A lamp according to claim 10, characterized in that said second material is $Ta_2O_5$.

* * * * *